United States Patent [19]

Sloan

[11] 4,342,410

[45] Aug. 3, 1982

[54] COMBINATION HAND GUN HOLSTER AND BELT

[76] Inventor: Neil B. Sloan, 1514 Ely Rd., Hixson, Tenn. 37343

[21] Appl. No.: 241,446

[22] Filed: Mar. 6, 1981

[51] Int. Cl.[3] ..... F41C 33/02

[52] U.S. Cl. ..... 224/243; 224/226; 224/911

[58] Field of Search ..... 224/243, 242, 244, 245, 224/246, 911, 912, 192, 193, 198, 224, 226

[56] References Cited

U.S. PATENT DOCUMENTS 3,904,091 9/1975 Jones ..... 224/243

*Primary Examiner*—Allan N. Shoap

*Attorney, Agent, or Firm*—Lamont Johnston

[57] ABSTRACT

A combination hand gun holster and belt is provided. The combination comprises a holster having inner and outer side panels which assist in forming a tapering configuration for conformably receiving a hand gun. The holster has an open end for insertion and withdrawal therethrough of the gun. The belt is attached to the inner side panel of the holster and suspends the holster on one side of the waist of a person. A retaining member is provided having first and second ends. The member is attached at the first end to the outer side panel of the open end of the holster. A means is provided for detachably mounting the second end of the retaining member to the belt. Thus when the retaining member is mounted to the belt the hand gun is safely retained in the holster and cannot be withdrawn therefrom. A release means is provided which is attached to the belt for automatically detaching the retaining member from the belt. The release means is adapted to be activated by the hand opposite the side from which the holster is suspended. Thus when the retaining member is released from the belt the gun can be withdrawn from the holster. Such a combination holster and belt prevents the accidental removal of the gun from the holster, e.g. in a chase, etc., or the removal of the gun from the holster by a person other than the person wearing the holster.

6 Claims, 3 Drawing Figures

10
12
14
16
18
20
22
24
26
28
30
32
34
35
36
38
40
42
44
46
48
50
52
54

COMBINATION HAND GUN HOLSTER AND BELT

BACKGROUND OF THE INVENTION

1. Field of the Invention

This invention relates to a combination handgun holster and belt, and particularly relates to a means for retaining the handgun in the holster to prevent accidental displacement therefrom or removal therefrom by a person other than the person wearing the holster and yet provides rapid access to the gun by the person wearing the holster.

2. Prior Art

It is a known social fact that as the population increases, so does the potential number of criminal offenses increase. It is also a known fact that a number of police officers are being shot annually with their own weapons by a percentage of the criminal element. It is also a known fact that an exposed weapon leads to temptation.

Many holsters now in general use are provided at their uppen open end with flaps or straps which bend over the projecting portion of the handgun, i.e. the grips, for maintaining the handgun in the holster. Such flaps or straps are generally connected to the outer wall of the holster by a readily detachable fastening means such as the stud and socket of a conventional snap fastener. When such holsters are used, it is necessary to first disconnect the snap fastener, then raise the flap or strap to enable the handle of the gun to be grasped for the purpose of removal of the gun from the holster. Such movement involves a certain amount of time. Such delay in removing the gun from the holster can be deadly in that quick action is important where the lives of officers, soldiers, sailors and other persons authorized to carry guns for defense purposes are in danger.

Many attempts have been made to eliminate such type retaining member from the holster, see for example the following U.S. Pat. Nos.: 1,635,984 to Corriston; 1,641,439 to Jovino; 2,109,734 to Preneta; 2,349,376 to Ray; 2,551,913 to Toby; 3,289,903 to Taormina; 3,718,240 to Rose; and 3,866,811 to Hamby.

All of the aforementioned references have discarded the use of the flap or strap over the handle of the handgun and gone to "quick-release" type devices attached to or within the holster itself to maintain the handgun in the holster. Such devices are of necessity fairly complicated, can tend to malfunction and generally may not provide for the positive retention of the gun in the holster. Thus, for example, there are many instances when a law enforcement officer may be handling a suspect without a drawn gun and it is possible for the suspect to gain a momentary advantage for the purpose of withdrawing the gun from the officer's holster. In addition it is possible that during a running chase a holster could be jarred loose from its holster and dropped to the ground.

OBJECTS AND SUMMARY OF THE INVENTION

Accordingly it is the main object of this invention to provide a combination handgun holster and belt capable of releasably securing a handgun in a holster.

Another object of this invention is to provide a means for securing a handgun in a holster which is readily releaseable whereby the person carrying the handgun may gain rapid access to and withdraw the handgun with little difficulty.

Still another object of this invention is to provide a combination handgun holster and belt which may be utilized by law enforcement officers.

A further object of this invention is to provide a combination handgun holster and belt which will retain a handgun inserted in the holster from being unintentionally withdrawn or accidentially ejected from the holster, but will permit quick intentional withdrawal of the handgun by the user thereof.

It is still a further object of this invention to provide a safety mechanism for handgun holsters which can be easily installed on existing holsters and belts which suspend such holsters.

These foregoing objects together with other objects and advantages of this invention are accomplished by a combination handgun holster and belt. The combination comprises:

a handgun holster having inner and outer side panels which assist in forming a tapering configuration for conformably receiving a handgun, the holster having an open end for insertion and withdrawal therethrough a handgun;

a belt attached to the inner side panel for suspending the holster on one side of the waist of a person;

a retaining member having first and second ends, the retaining member being attached at the first end to the outer side of the panel of the open end of the holster;

a means for detachably mounting the second end of the retaining member to the belt, whereby when the retaining member is mounted to the belt the gun is safely retained in the holster and cannot be withdrawn therefrom; and a release means attached to the belt for automatically detaching the retaining member from the belt by utilizing the hand opposite the side from which the holster is suspended, whereby when the retaining member is released from the belt the handgun can be withdrawn from the holster.

BRIEF DESCRIPTION OF THE DRAWING

Further objects and advantages of this invention will be pointed out in the following detailed description and drawings in which.

DETAILED DESCRIPTION OF THE INVENTION

Figures 1, 2:
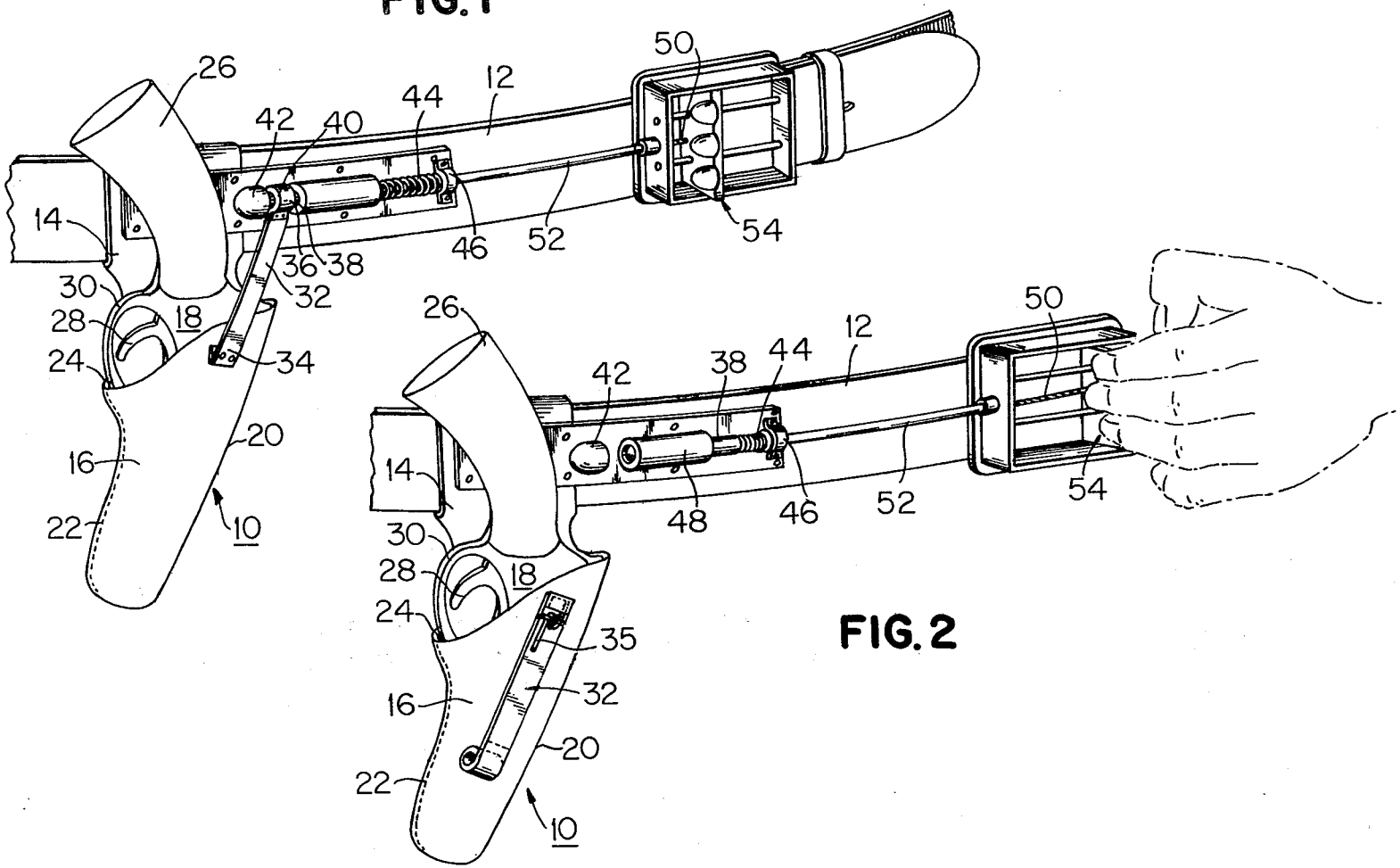
FIG. 1 is a perspective view of an embodiment of the combination holster and belt of this invention showing a gun mounted in the holster.
FIG. 2 is a perspective view of the combination holster and belt wherein the gun is ready for drawing from the holster.

Referring now more particularly to the drawings, which depict the combination handgun holster, generally designated (10) and belt (12). The holster (10) has an inner side panel (14) and an outer side panel (16). These side panels (14 and 16) assist in forming a tapering configuration for conformably receiving a gun (18). The holster (10) may be fabricated of leather, or other suitable material as desired, and may be formed of a single piece of sheet material. For example, as depicted in FIG. 1 and 2, the inner side panel (14) is integral with the outer side panel (16) as by a fold or bend (20) along one side edge, and having the other edges secured together by suitable means such as stitching (22).

At least one end of the holster (10) is open, typically the larger end (24). This open end (24) is suitable for the insertion and withdrawal therethrough of the gun (18).

The gun (18) is typically the conventional type gun which includes an elongated barrel (not shown) having a hand grip or handle (26) at one end of the barrel. A trigger (28) extends from the barrel adjacent the handle (26) and is generally enclosed by a trigger guard (30). When the gun (18) is engaged in the holster (10), at least the barrel, trigger guard (30) and trigger (28) are within the holster (10) between the facing inner and outer side panels (14 and 16) of the holster (10). The handle (26) may extend beyond the open holster end (24).

A belt (12) is attached to the inner side panel (14). This may be accomplished, for example, by vertical slits in or a loop on the inner side panel (14) through which the belt (12) passes, or by riveting the inner side panel (14) to the belt (12). This provides a means for suspending the holster (10) on one side of the waist of a person. Such a means for suspending a holster from the waist of a person is well known in the art and the conventional means of accomplishing such are contemplated by this invention.

Figure 3:
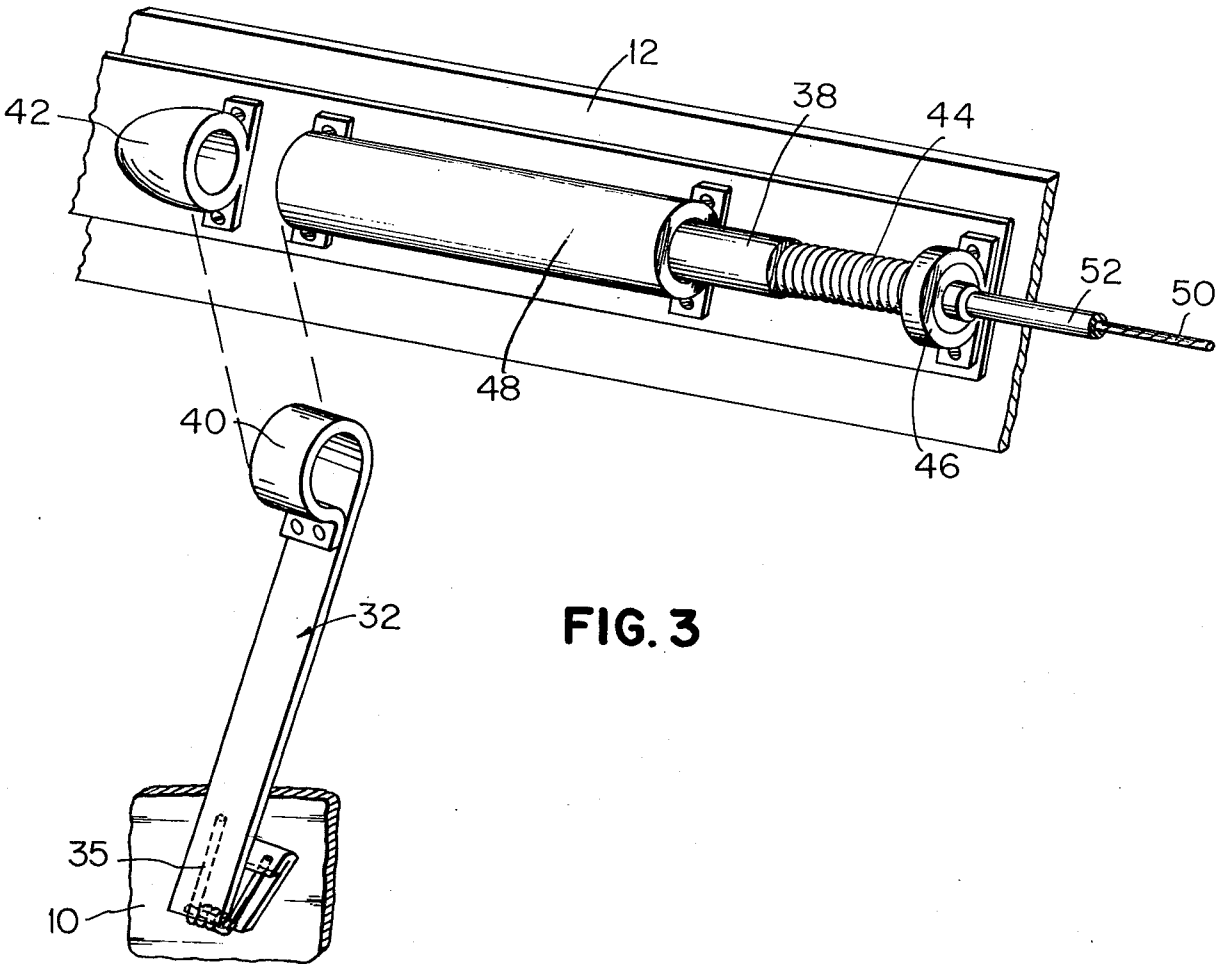
FIG. 3 is an enlarged perspective view of the sliding locking member and spring means attached thereto forming a part of the locking and release mechanism of FIG. 2.

A retaining member, generally designated (32), in the form of a strap or flap is utilized having a first end (34) and a second end (36). The first end (34) of the retaining member (32) is attached to the outer side panel (16) adjacent to the open end (24) of the holster (10). Preferably this is accomplished at a point prior to the root of the handle (26), for example over the hammer (not shown) of the gun (18). The attachment of the first end (34) of the retaining member (32) is not critical and as shown in FIG. 1 may be accomplished by rivetinng and/or stitching. Optionally, such attachment may be accomplished through a snap means to permit the release of the hand gun from the holster in the conventional manner. As shown, however, in FIGS. 2 and 3 the first end (34) may be provided with a spring release means (35) for automatically swinging the retaining member (32) away from belt (12).

A means is provided for detachably mounting the second end (36) of the retaining member (32) to the belt (12). As shown in the Figures, such a means is comprised of a locking member (38) which is slidably mounted to the belt (12) and an enclosure means, generally designated (40) (see FIG. 3) is attached to the second end (36) of the retaining member (32) for slidably engaging an end of the locking member (38). As shown in the Figures the enclosure means (40) is a loop at the end of the retaining member (32) which encloses the locking member (38) at its end. When the retaining member (32) is in its closed position the end of the locking member (38) is preferably supported and held to the belt by member (42) which has a portion thereof attached to the belt and a portion thereof open for insertion of the end of the locking member (38). Thus when the retaining member (32) is mounted to the belt (12) the gun (18) is safely retained in the holster and cannot be withdrawn therefrom.

A release means is attached to the belt (12) for automatically detaching the retaining member (32) from the belt (12) by utilizing the hand opposite the side from which the holster (10) is suspended. As depicted in the Figures, the release means is comprised of a spring retained locking member (38). As shown, the locking member (38) has a compressable spring (44) which is in the relaxed position when locking member (38) engages the enclosure means (40), and member (42). The spring (44) is compressed between the end of locking member (38) and a retaining member (46). The retaining member (46) is attached to the belt (12), by, for example, rivets. A sheath (48) encloses the locking member (38) to provide for the unobstructed sliding of the locking member (38). Attached through the center of helical spring (44) is a cable (50), which may also be provided with a sheath (52). The cable (50) is attached to a release handle (54). The release handle (54) is attached to the belt (12) near the front of the person, i.e. the abdomen. Preferably, as indicated in FIGS. 1 and 2, the release handle (54) is slidably mounted to the closure buckle of the belt (12).

In use, the end (36) of retaining member (32) is slipped over the end of locking member (38) and the locking member (38) is placed in holding member (42). With, for example, the left hand, the release handle (54) is pulled, drawing cable (50) which pulls locking member (38) from the enclosure means and holding member (42), thus releasing the retaining member (32) which springs away from belt (12). Spring (44) is compressed and, when the handle is released, the locking member returns to its normal position.

A retainer latch made in accordance with my invention secures a handgun until use of it is needed. It holds the gun in a snugly fitting, neat and dressy position and gives the wearer of the weapon mental security. It is foolproof in operation and positively insures that the gun can not be removed by anyone other than the wearer. It allows rapid release and access to use of the gun. It allows a right-handed user to have his right hand free at all times. It is simple and inexpensive in construction and can be readily attached to gun holsters already available. This retainer latch secures a handgun firmly in position regardless of the body position of the wearer.

The foregoing is considered as illustrative only of the principles of this invention. Further, since numerous modifications and changes would readily occur to those skilled in the art, it is not desired to limit the invention to the exact construction and operation shown and described, and accordingly all suitable modifications and equivalence may be resorted to, falling within the scope of the invention.

What is claimed is:

1. A combination handgun holster and belt comprising:

a handgun holster having inner and outer side panels which assist in forming a tapering configuration for conformably receiving a handgun, the holster having an open end for insertion and withdrawal therethrough of a handgun;

a belt attached to the inner side panel for suspending the holster on one side of the waist of a person;

a retaining member having first and second ends, said retaining member being attached at the first end to the outer side panel of the open end of the holster;

a means for detachably mounting the seconnd end of the retaining member to the belt, whereby when the retaining member is mounted to the belt the handgun is safely retained in the holster and cannot be withdrawn therefrom; and a release means attached to the belt for detaching the retaining member from the belt by utilizing the hand opposite the side from which the holster is suspended, whereby when the retaining member is released from the belt the handgun can be withdrawn from the holster.

2. The combination holster and belt of claim 1, wherein the means for detachably mounting the second end of the retaining member comprises:

a locking member slidably mounted to the belt; and an enclosure means attached to the second end of the retaining member for slidably engaging an end of the locking member.

3. The combination holster and belt of claim 2, wherein the release means comprises a spring retained locking member having a release handle attached to the other end of the locking member, the release handle attached to the belt near the front of the person.

4. The combination holster and belt of claim 1, wherein the release means comprises a spring retained locking member slidably mounted to the belt, the locking member releaseably engaging the second end of the retaining member at one end of the locking member, and having a release handle attached to the other end of the locking member, the release handle being attached to the belt near the front of the person.

5. The combination holster and belt of claim 1, wherein the release means is activated by a release handle attached to the belt near the front of the person.

6. The combination holster and belt of claim 5, 4 or 3, wherein the release handle is slidably mounted to the closure buckle of the belt.

* * * * *